United States Patent [19]

Cash

[11] Patent Number: 4,671,855

[45] Date of Patent: Jun. 9, 1987

[54] PAPER SIZING AND COMPOSITION AND METHOD

[75] Inventor: Gordon G. Cash, Southbury, Conn.

[73] Assignee: Olin Corporation, Cheshire, Conn.

[21] Appl. No.: 787,538

[22] Filed: Oct. 15, 1985

[51] Int. Cl.[4] ..... D21H 3/16

[52] U.S. Cl. ..... 162/158; 8/116.1; 8/181; 162/179

[58] Field of Search ..... 162/158, 179; 8/116, 8/181

[56] References Cited

U.S. PATENT DOCUMENTS

| | | | |
|---|---|---|---|
| 3,337,636 | 8/1967 | Scanley | 260/607 |
| 3,576,712 | 4/1971 | Hine et al. | 162/168.1 |
| 4,043,863 | 8/1977 | Bjorklund et al. | 162/158 |

OTHER PUBLICATIONS

Chem. Abst., 68, (1968), 96720n.
Chem. Abst., 92 (1980) 182829g.
Chem. Abst. 98, (1983), 181440k.

*Primary Examiner*—Peter Chin
*Attorney, Agent, or Firm*—William A. Simons; Thomas P. O'Day

[57] ABSTRACT

A paper sized with a 2-nitrobenzene sulfonate is disclosed.

12 Claims, No Drawings

PAPER SIZING AND COMPOSITION AND METHOD

RELATED APPLICATIONS AND PATENTS

The invention described herein is related to that described in co-pending application Ser. No. 629,516 of Gordon G. Cash, filed July 10, 1984, now U.S. Pat. No. 4,551,201, which issued on Nov. 5, 1985.

BACKGROUND OF THE INVENTION

1. Field of the Invention

The present invention relates to a method and composition for sizing cellulosic fibers or cellulosic fiber-containing material.

2. Prior Art

Numerous compositions and methods have been suggested heretofore for sizing paper, i.e., rendering the paper more resistant to penetration by liquids. Materials such as resin, various hydrocarbon and natural waxes, starches, glues, casein, asphalt emulsions, synthetic resins and cellulose derivatives have been employed as sizing agents. See, e.g., U.S. Pat. Nos. 3,084,093; 3,084,092; 2,995,483; 2,964,445; 2,941,919; 2,903,391; 2,872,315; 2,830,916; 2,764,483; 2,684,300, and the like.

Typically, such derivatives are added directly to the paper making stock as "beater additives" and precipitated on the paper as it is formed to yield "internal" or "engine" sizing. Alternatively, the paper sheet may be passed, after formation, through a size solution, or over a roll wetted with the size solution to produce "tub-sized" or "surface-sized" paper sheets.

Reagents containing functional groups or which are merely precipitated on paper which react with the cellulose content of paper have also been utilized as sizing agents.

For example, U.S. Pat. No. 3,050,437 discloses the use of hydrophobic isocyanates as tub-sizing agents.

U.S. Pat. No. 3,337,636 discloses that various substituted trisulfonylmethanes may be employed to size paper by precipitation thereof on the cellulose fibers of the paper.

Westfelt et al, Cellul. Chem. Technol., Vol. 17(2), pp. 165–77 (1983) discloses the utilization of certain sulfonyl reagents as wet strength additives for paper.

Lukyanwa, Tekst. Prom. (Moscow), Vol. 27(8), pp. 51–2 (1967) [Chemical Abstracts 68, 96720n (1968)] and Rabinovich et al, Khim. Tekhnol. Proizrod. Tsellyul (1968) pp. 148–56 [Chemical Abstracts, 72, 91609f (1970)] relate to the utilization of cellulose ethanesulfonate as a sizing agent for cellulose fibers. The derivative is, however, precipitated on the fibers.

U.S. Pat No. 4,043,863 discloses the use of sulfamoylchlorides as cellulose fiber sizing agents.

U.S. Pat. No. 3,576,712 relates to the use of a composition containing a 2-chloroalkyl sulfone, a 2-chloroalkyl sulfoxide or a 2-chloroalkyl sulfide as paper sizing agents.

In U.S. Pat. No. 4,551,201 there is described a method for tub- or surface-sizing paper and other cellulose fiber-containing substrates by reacting the cellulose fibers with a sizing agent having the formula:

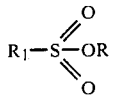

wherein:

$R_1$ is an alkyl group having from 1 to 5 carbon atoms, and

R is an alkyl group having from 12 to 24 carbon atoms.

The method, however, generally requires the use of organic solvents since the sulfonates are either insoluble in water or will not react with cellulose in emulsion form. Moreover, it is usually necessary to conduct the reaction at an akaline pH, preferably after pre-treating the substrate with a suitable base, followed by drying. Finally, it is necessary to remove excess organic solvent and base following the reaction, thereby adding to the overall cost and decreasing the efficiency of the method.

It is an object of the present invention to provide a novel composition and method for sizing cellulose fiber containing substrates based on the use of certain long chain alkyl sulfonates which are not subject to the disadvantages associated with the method and composition described in U.S. Pat. No. 4,551,201.

SUMMARY OF THE INVENTION

One embodiment of the present invention comprises nitrobenzenesulfonates of the formula:

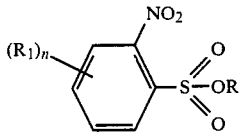

wherein:

$R_1$ is H or halogen, i.e., chloro, bromo, iodo, or fluoro,

R is an alkyl group having from 12 to 24 carbon atoms, and n is an integer from 0 to 4.

The present invention also provides a method for sizing cellulose fibers or cellulose fiber-containing material comprising reacting said cellulose fibers with an amount of a sizing agent sufficient to render said cellulose fibers hydrophobic, the sizing agent having the formula:

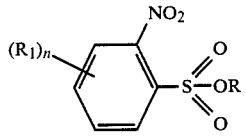

wherein:

$R_1$ is H or halogen, i.e., chloro, bromo, iodo, or fluoro,

R is an alkyl group having from 12 to 24 carbon atoms, and n is an integer from 0 to 4.

The present invention also provides a composition for sizing cellulose fibers or cellulose fiber containing substrates comprising an aqueous emulsion of an organic sulfonate having the formula:

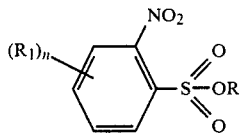

wherein:

$R_1$ is H or halogen,

R is an alkyl group of 12 to 24 carbon atoms, and n is an integer from 0 to 4.

DETAILED DESCRIPTION OF THE INVENTION

The present invention is predicated on the discovery that unlike most of the organic sulfonates described in U.S. Pat. No. 4,551,201, the above described sulfonates will react with cellulose fibers in the form of an aqueous emulsion and do not require an alkaline pH to support the reaction. Moreover, the nitrobenzenesulfonates described herein react with cellulosic fibers to increase the hydrophobicity thereof to essentially the same degree as the organic sulfonates described in U.S. Pat. No. 4,551,201. Therefore, the method and composition of the invention are useful for the treatment of any cellulosic fiber-containing material where it is desired to render the fibers or materials resistant to the penetration of liquids, particularly water. Thus, the invention may be utilized to size paper, treat cotton to decrease dye penetration, or increase the hydrophobic character of any other cellulosic material having reactive OH groups.

There is thus no need to provide an alkaline pH to support the reaction not to pre-treat the cellulosic substrate with a base. Additionally, it is not necessary to utilize an organic solvent to solubilize the sulfonate for reaction with the cellulosic fiber. The elimination of these steps also avoids the necessity for washing the sized substrate to remove excess base, organic solvent, etc.

Most importantly, however, the ability of the nitrobenzenesulfonates to react with cellulose fibers in the form of an emulsion enables the adaption of the process to "internal" or "engine" sizing procedures. Whereas the alkaline conditions necessary to support the sizing reaction when using the sulfonate of U.S. Pat. No. 4,551,201 far exceed those normally found in the head box or other stage of a paper making process, for example, the nitrobenzenesulfonates will readily react with cellullose fibers in the head box or at any other stage of a paper-making system wherein additives can be added to the fibers in emulsion form.

It is preferred, however, to "surface" size paper after formation thereof according to conventional papermaking techniques. Any of the known surface-sizing techniques may be employed to carry out the invention. Thus, paper sheets may be passed through a tub of an emulsion of the organic sulfonate or passed over a roller or other applicator in contact with an emulsion of the sulfonate. Those skilled in the art, having been exposed to the principles of the invention, will be aware of suitable techniques for achieving the sizing reaction without the exercise of undue experimentation.

When sizing paper it is preferable to react the cellulosic fibers thereof with about a 1.2% weight/volume emulsion of the organic sulfonate. Amounts less than 0.5% weight/volume will not enhance the hydrophobicity of the cellulosic fibers to any significant degree. Generally, amounts greater than about 1.2% weight/volume will not result in any added degree of hydrophobicity.

The preferred organic sulfonate is octadecyl-2-nitrobenzenesulfonate, i.e., the compound of the above formula wherein n is 0 and R is octadecyl.

The nitrobenzenesulfonate is emulsified in water according to any known or conventional technique for emulsifying insoluble organic compounds in water. Although not critical it is preferred to utilize an emulsifying agent in order to obtain a homogenous, stable dispersion. Suitable emulsifiers include sodium liquin sulfonate, N-alkyl-N-ethylmorpholinium ethosulfate, polyoxyethylene alkyl ether, and the like. The only requirement for the emulsifier is that it comprise one which is inert with respect to the cellulose fibers and any other component of the cellulose fiber substrate to be sized.

The emulsion should contain from about 0.5 to about 1.2% by weight/volume of nitrobenzene-sulfonate, in order to enable the reaction with the cellulose fibers to proceed efficiently.

It is preferred to conduct the reaction at a temperature of from about 100° C. to about 125° C. in order to drive the reaction to completion in an economically efficient manner.

The reaction between the cellulosic fibers and the organic sulfonate sizing agent is generally completed in from about 0.5 to about 2 min. when conducted at the above temperatures.

Following completion of the reaction between the cellulosic and organic sulfonate, the cellulosic fiber-containing material is dried to produce the sized product. Optimal drying may be accomplished by heating the material at a temperature of from about 100° to about 125° C.

The invention is illustrated by the following non-limiting examples.

EXAMPLE 1

Sheets of paper (basic wt. 25 g/cm$^2$, Greiner porosity 45 mL/15 sec., 25% $CaCo_3$ filler) were sized with emulsions of octadecyl 2-nitrobenzenesulfonate according to the following method:

The paper was squeezed between rubber rollers in a laboratory size press. Simultaneously, the rollers were wetted with the emulsion. Excess emulsion was then squeezed out of the paper in a second pan through the rollers. The papers were dried at 120° C. for 120 sec. to assure full development of sizing and drying. The emulsions were prepared by dissolving the nitrobenzenesulfonate in 20 ml of warm toluene and blending the solution with water, starch, and emulsifying agent (sodium lignin sulfonate) in a high-speed blender.

The effectiveness of the sizing reaction was determined with a Hercules Sizing Tester, Model KA. This instrument measures, by reflectance, the speed of penetration of an aqueous ink through the sheet.

The sized paper (1.2% w/v emulsion) exhibited an ink penentration time greater than 800 seconds. The untreated paper exhibited an ink penetration time of 0.5 second.

Those skilled in the art, having been exposed to the principles of the invention, will be able to determine optimum reaction parameters, depending upon the particular cellulosic fiber-containing material to be sized and the organic sulfonate selected without the exercise of undue experimentation.

The nitrobenzenesulfonates utilized as sizing agents in the method, composition and product of the invention may be prepared according to a modification of the method of Crossland et al. [J. Org. Chem., Vol. 35, pp. 3195–96 (1970)]; i.e., the addition of an excess of a sulfonyl chloride to a solution of the esterfying long chain alcohol in an appropriate solvent containing triethylamine. Those skilled in the art will recognize that longer chain alcohol reactants will require less polar solvents.

Identical tests were conducted utilizing octadecyl 4-nitrobenzenesulfonate which proved to be an inadequate sizing agent under the same conditions. The Hammett equation [Jaffe, Chem. Revs., Vol. 53, pp. 191–26, (1953)], which does not apply to reactions involving aromatic nuclei with substituents in the 2-position, predicts that the 3-nitrobenzenesulfonates would be even less reactive than the 4-isomers.

I claim:

1. A method for sizing cellulose fibers or cellulose fiber-containing material comprising reacting said cellulose fibers with an amount of a sizing agent sufficient to render said cellulose fibers hydrophobic, said sizing agent having the formula:

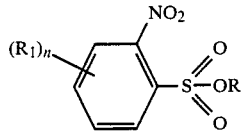

wherein:

$R_1$ is H or halogen

R is an alkyl group having from 12 to 24 carbon atoms, and n is an integer from 0 to 4.

2. The method of claim 1 wherein said cellulose fibers are contained in paper.

3. The method of claim 2 wherein the cellulose fibers of said paper are reacted with a solution of said sizing agent containing from about 0.5% to about 1.2% weight/volume of said sizing agent.

4. The method of claim 2 wherein said paper is wetted with an aqueous emulsion of said sizing agent for a time sufficient to allow said reaction to occur.

5. The method of claim 1 where n=0 and R is octadecyl.

6. The method of claim 4 wherein said emulsion of sizing agent contains an emulsifying agent which is inert with respect to said cellulose containing material.

7. The method of claim 4 wherein said paper is reacted with said emulsion of sizing agent at a temperature from about 100° to about 125° C.

8. The method of claim 4 wherein n =0, R is octadecyl, and said emulsion contains rrom about 0.5% to about 1.2%, weight/volume of said sizing agent.

9. The method of claim 4 wherein said paper is dried by heating after reaction of said sizing agent with said cellulose.

10. The method of claim 9 wherein said drying by heating is carried out at a temperature of from about 100° to 0.5° C.

11. The method of claim 4 wherein said sizing agent is allowed to react with the cellulose in said paper for a time of from about 0.5 to about 2 min.

12. The sized cellulose fiber or cellulose containing material produced according to the method of claim 3.

* * * * *